US005803122A

United States Patent [19]

Theilmeier

[11] Patent Number: 5,803,122

[45] Date of Patent: Sep. 8, 1998

[54] RECIPROCATING PUMP VALVE

[76] Inventor: Thomas Theilmeier, 140 Kingsland St., Nutley, N.J. 07110

[21] Appl. No.: 799,245

[22] Filed: Feb. 14, 1997

[51] Int. Cl.[6] ..... F16K 15/14

[52] U.S. Cl. ..... 137/854; 417/571

[58] Field of Search ..... 137/854; 417/571

[56] References Cited

U.S. PATENT DOCUMENTS

| | | | |
|---|---|---|---|
| 3,228,418 | 1/1966 | Rosback et al. . | |
| 3,911,949 | 10/1975 | Hilden et al. | 137/525 |
| 3,990,439 | 11/1976 | Klinger | 137/854 |
| 4,204,555 | 5/1980 | Durling | 137/854 |
| 4,428,392 | 1/1984 | Jones et al. | 137/102 |
| 4,610,275 | 9/1986 | Beecher | 137/854 |
| 4,640,293 | 2/1987 | Garbe | 128/716 |
| 4,749,003 | 6/1988 | Leason | 137/854 |
| 4,842,498 | 6/1989 | Bramstedt et al. | 415/571 |
| 4,854,839 | 8/1989 | DiFlora | 417/571 |
| 4,934,362 | 6/1990 | Braun | 128/207.12 |
| 5,103,854 | 4/1992 | Bailey et al. | 137/102 |
| 5,161,571 | 11/1992 | Nakazawa et al. | 137/854 |
| 5,167,615 | 12/1992 | East et al. | 137/854 |
| 5,266,015 | 11/1993 | Gannaway | 137/854 |
| 5,295,478 | 3/1994 | Baldwin | 128/203.11 |
| 5,325,892 | 7/1994 | Jupuntich et al. | 137/855 |
| 5,419,366 | 5/1995 | Johnston | 137/854 |

FOREIGN PATENT DOCUMENTS

| | | | |
|---|---|---|---|
| 1183786 | 9/1957 | France | 137/854 |
| 63-113779 | 7/1988 | Japan | 137/855 |
| 391326 | 11/1973 | U.S.S.R. | 137/854 |
| 541578 | 7/1939 | United Kingdom | 137/854 |
| 535467 | 3/1940 | United Kingdom | 137/854 |
| 1600614 | 10/1981 | United Kingdom | 137/854 |

*Primary Examiner*—Denise L. Ferensic
*Assistant Examiner*—Joanne Y. Kim
*Attorney, Agent, or Firm*—Van Dyke, Gardner, Linn & Burkhart, LLP

[57] ABSTRACT

A diaphragm valve for a high speed reciprocating pump includes a valve seat defining at least one channel for fluid to flow through. The channel includes a support disposed therein. A diaphragm extends over the channel and is biased towards a closed position by a raised rim on the valve seat. An indented valve face under the diaphragm is shaped such that the fluid will exert a forward force on an area of the diaphragm which is greater than the cross-sectional area of the channel. The support in the channel supports the diaphragm during the reverse cycle of fluid flow. The valve therefore is durable and consumes a minimal amount of energy.

25 Claims, 3 Drawing Sheets

RECIPROCATING PUMP VALVE

BACKGROUND OF THE INVENTION

This invention relates generally to a valve for a reciprocating pump. More particularly, this invention relates to a one-way flow valve for a high speed reciprocating pump.

Valves for high speed pumps involve special design considerations not typically present in other types of valves. For example, energy considerations play a paramount role in high speed pump valves, while such considerations rarely enter into the design of intermittently operated valves, such as respiratory valves or fuel tank valves. Another important consideration in the design of high speed pump valves is the durability of the valve. The high speed nature of the pump results in a significant amount of strain on the valve which is not found in low speed, or intermittent, valves. Likewise the high speed of the pump requires the valve to have a high response speed in order to efficiently provide the high flow rate that the pump could otherwise produce.

With respect to the energy considerations, the power consumed by a pump to move a given quantity of fluid is directly proportional to the increase or decrease in pressure experienced by the fluid as it moves through the system. In applications where the system pressure is very close to the ambient pressure, the bulk of the pressure changes occur due to restrictions in the valves and ports in the system. To minimize these changes, and thereby reduce the power consumed by the pump, the size of the ports and valves are made as large as is practicable. An increase in the size of the valve, however, requires that the valve membrane be made thicker and stiffer in order to support the pressure differential across the valve during the reverse cycle of fluid flow. Increasing the thickness of the valve membrane, though, increases the pressure necessary to crack open the valve membrane and thereby increases power consumption. Therefore, the efficiency of high speed valves is typically limited by the thickness of the valve membrane.

To ensure that the valve will be durable enough to withstand the strains of a high speed environment, various aspects of the valve design can be adjusted. One area is the material of the valve membrane. The valve membrane should be made of a material that is both pliable enough to not require excessive power to open, and strong enough to withstand the pressure difference of the reverse cycle. Another area relating to valve durability is the overall configuration of the valve. Different configurations will provide differing degrees of support for the valve membrane, thereby affecting the durability of the valve. The valve configuration and material of the valve membrane will also affect the power consumption of the valve, and it therefore can be seen that a compromise is drawn in the design of high speed valves between durability and power consumption. Thus, a major valve design goal is to create a valve which is more efficient and yet does not result in a commensurate decrease in valve endurance, or vice versa.

SUMMARY OF THE INVENTION

According to one preferred aspect of the present invention, a diaphragm valve is provided for a high speed reciprocating pump which only allows fluid to flow in a downstream direction and includes a valve seat having an upstream and a downstream side. A valve face is indented into the valve seat and surrounded by a rim. At least a portion of the valve face extends into the valve seat at an angle such that the valve face is deepest at its outermost perimeter. At least one channel through which the fluid enters the valve opens through the valve face within the valve seat. A diaphragm is disposed on the downstream side of the valve seat and covers the valve face and the rim, such that when the diaphragm is seated the diaphragm is bowed and biased toward a closed position. The diaphragm is disposed in the valve seat such that the upstream surface of the diaphragm is fluidly sealed against the rim when in a closed position. The angled or concaved indentation of the valve face ensures that the upstream surface of the diaphragm that is in contact with the fluid is greater than the cross sectional area of the channel. The valve therefore allows the fluid to exert a pressure against the upstream surface of the diaphragm over an area greater than the total cross-sectional area of the channel. This enables the valve to consume less power to crack open the valve membrane, and yet still be durable and long lasting. The bowed configuration of the membrane increases the resilient closing force generated by the membrane at the end of the pump stroke so as to increase the closing reaction speed of the valve.

In another preferred aspect of the invention, the channel that opens through the valve face has an enlarged area that maximizes the size of the opening at the valve face. A support is positioned within the channel in order to provide a supporting point of contact for the membrane at the valve face. Preferably the support is positioned by a mounting element located within the channel and upstream of the valve face in order to maximize the unrestricted open flow area of the channel at the valve face.

The combination of the valve seat which maintains the membrane in a concave shape, the enlarged channel with a remotely mounted support, and angled valve face produces a highly efficient, fast-acting and durable valve. The valve membrane may be formed from a thinner highly responsive material since the membrane is supported at the enlarged channel, and the valve configuration requires reduced cracking pressures to provide quick opening response. The preflexed closed position results in a higher closing force in order to provide quick closing response. In a high speed pump environment the combination of features of the present valve provides improved pump performance.

These and other benefits, results, and objects of the present invention will be apparent to one skilled in the art, in light of the following specification when read in conjunction with the accompanying drawings.

DESCRIPTION OF THE PREFERRED EMBODIMENT

Figure 1:
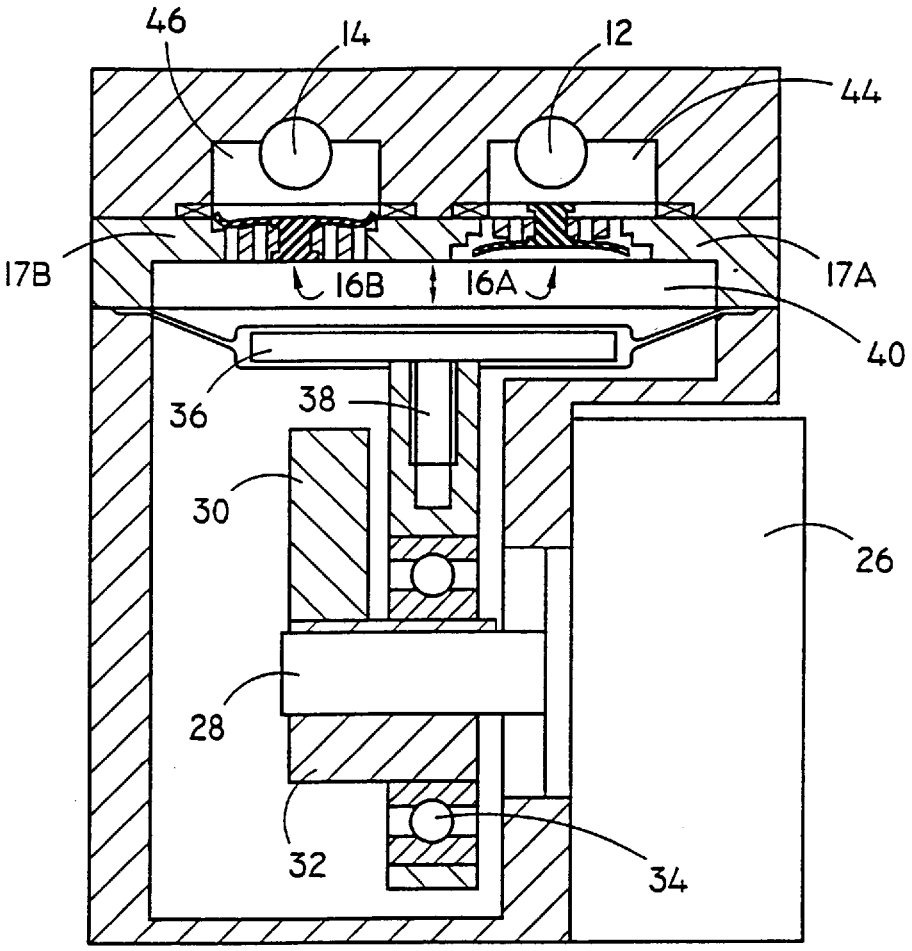
FIG. 1 is an elevational, sectional view of a high speed reciprocating pump incorporating a pair of valves according to one embodiment of the present invention.
Figure 2:
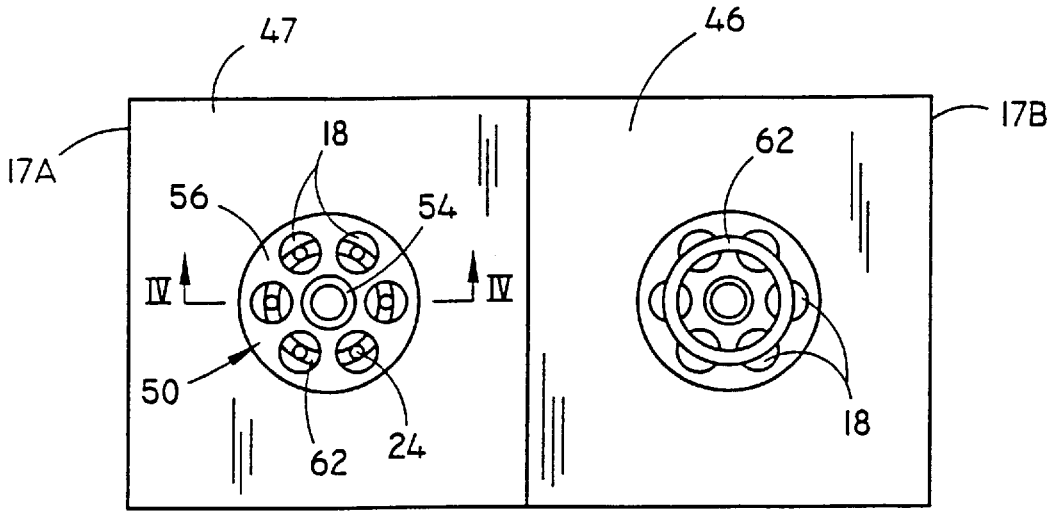
FIG. 2 is a plan view of a pair of valve seats in which the pair of valves of FIG. 1 are disposed.
Figure 5:
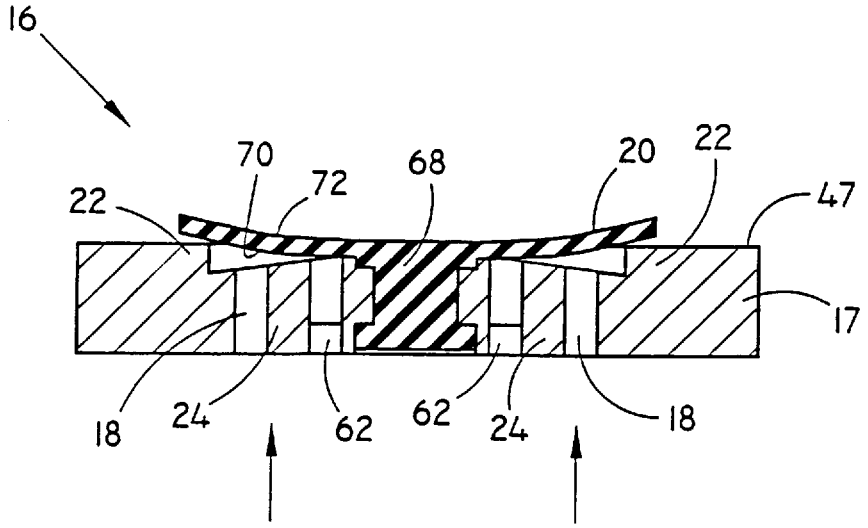
FIG. 5 is an elevational view of the valve of FIG. 4 including the valve diaphragm shown in a closed position; and, FIG. 6 is an elevational view of the valve of FIG. 5 shown in an open position.

The present invention will now be described with reference to the accompanying drawings wherein like reference numerals correspond to like elements in the several drawings. A high speed reciprocating pump 10 for pumping fluids is illustrated in FIG. 1. Pump 10 pumps fluid in from an intake or suction port 12 and out through a discharge port 14. In pump 10 the fluid is prevented from flowing in an opposite direction by a pair of inlet and outlet diaphragm valves 16*a, b* each disposed in a valve seat 17*a, b*. Diaphragm valves 16*a, b* each include a plurality of cylindrical channels 18 through which the fluid flows (FIG. 2). A diaphragm 20 is disposed on each diaphragm valve 16*a, b* over a downstream end of channels 18 and alternates between a closed and an open position (See FIGS. 5 and 6). Diaphragm valve 16 includes a raised rim 22 surrounding channels 18 which bows diaphragm 20 and consequently biases diaphragm 20 towards a closed position. A support 24 is disposed in each channel 18 and provides support for diaphragm 20 when a backward pressure is exerted on diaphragm 20.

Reciprocating pump 10 includes a motor 26 connected to a shaft 28 which turns when motor 26 is activated (FIG. 1). A counter weight 30 and crank eccentric 32 are disposed on opposite sides of shaft 28. The rotation of shaft 28 and crank eccentric 32 forces a ball bearing assembly 34 to move linearly up and down, or reciprocate, in a vertical direction. The vertical linear reciprocation of ball bearing assembly 34 is transmitted to a pump diaphragm 36 by way of a vertical connecting rod 38 disposed therebetween. A pumping chamber 40 is defined between pump diaphragm 36 and valve seats 17*a* and *b* in which diaphragm valves 16*a* and *b* are disposed. Pump diaphragm 36 fluidly seals the bottom of pumping chamber 40 such that fluid can only enter and exit pumping chamber 40 via diaphragm valves 16*a* and *b*. During the forward stroke of pump 10, i.e. when diaphragm 36 of pump 10 is moving upward in FIG. 1, the fluid pressure in pumping chamber 40 is increased and fluid is forced out of pumping chamber 40 through outlet diaphragm valves 16*b* to a discharge plenum or chamber 46 and out discharge port 14. During the return stroke of pump 10, i.e. when diaphragm 36 on pump 10 is moving downward, the fluid pressure in pumping chamber 40 is reduced and fluid is drawn in from suction port 12, through an inlet plenum 44 and inlet diaphragm valve 16*a*, and into pumping chamber 40. Diaphragm 20 on inlet valve 16*a* prevents fluid from back flowing out through inlet valve 16*a* during the forward stroke of pump diaphragm 36. Diaphragm 20 on outlet diaphragm valve 16*b* prevents fluid from back flowing through outlet valve 16*b* during the return stroke of pump diaphragm 36. In operation, therefore, reciprocating pump 10 will pump fluid in from suction port 12 and out discharge port 14. It will be understood that the present invention is directed to diaphragm valves 16*a* and *b*, and that reciprocating pump 10 may take on a variety of different embodiments other than that illustrated in FIG. 1. Preferably, however, pump 10 is a high speed reciprocating pump with an operating speed in excess of about 1,500 RPM, and most preferably in a range of 3,000 RPM or higher. It will be further understood that diaphragm valves 16*a* and *b* are equally operable with both a gas pump or a liquid pump.

Figure 3:
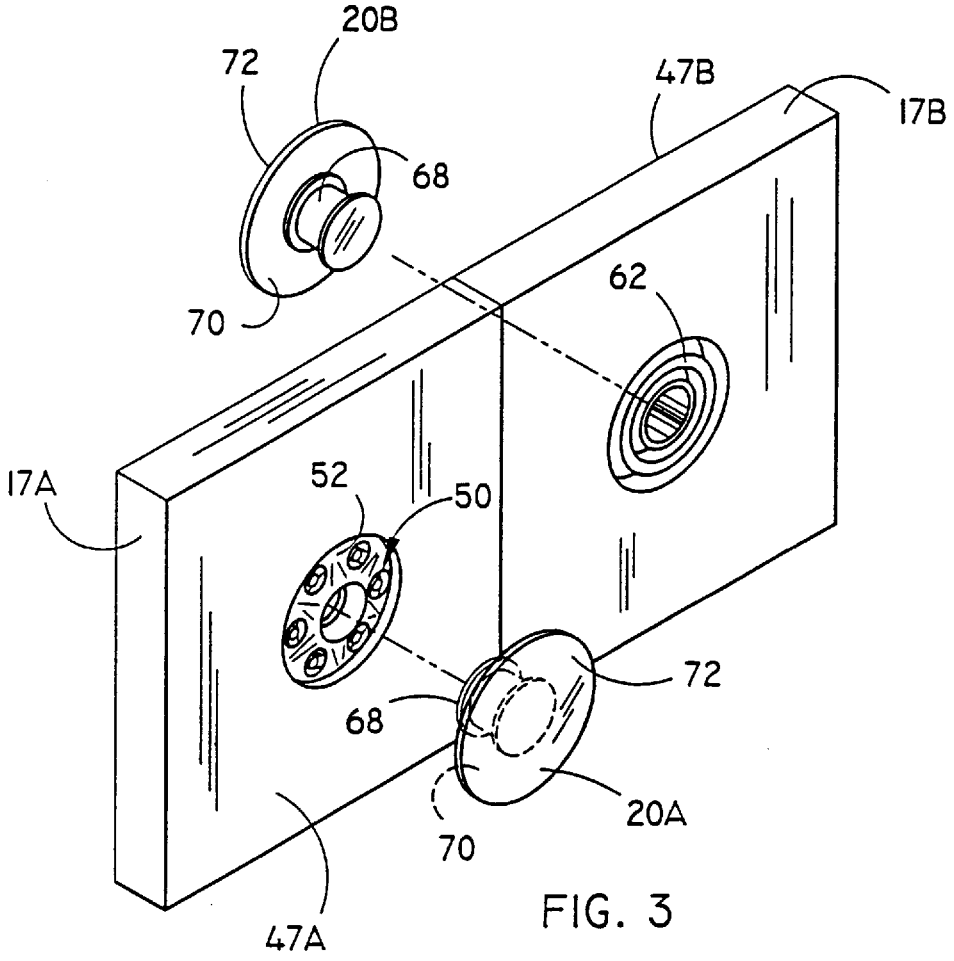
FIG. 3 is an exploded, perspective view of the pair of valve seats, including a pair of valve diaphragms.

Inlet and outlet valves 16*a* and *b* are each disposed in valve seats 17*a* and *b*, respectively, facing opposite directions (FIGS. 2 and 3). Because inlet and outlet valves 16*a* and *b* are identical in all respects except for their orientation in pump 10, description will be made of only one valve 16 which will be equally applicable to both.

Figure 4:
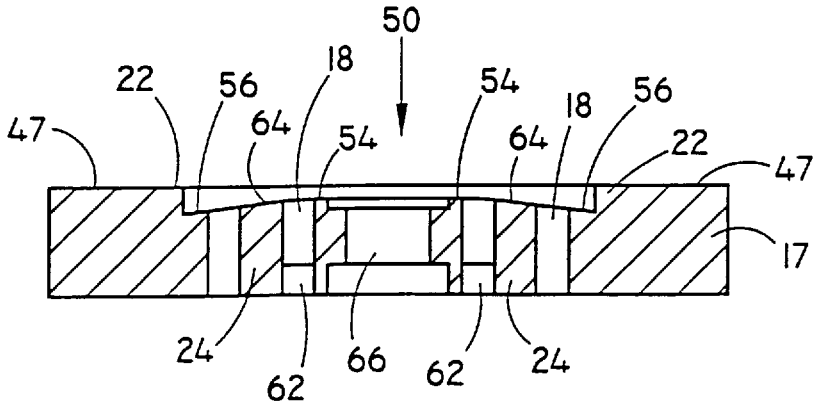
FIG. 4 is a sectional, elevational view taken along the line IV—IV of FIG. 2.

As shown in FIG. 4, the interior of raised rim 22 defines a circular valve face 50 which is indented into a downstream side 47 of valve seat 17 from raised rim 22. In the preferred embodiment, valve face 50 has a frusto-conical shape made up of a central, circular, flat surface 54 which is surrounded by an angled, conical surface 56. Circular flat surface 54 is indented into valve seat 17 from raised rim 22 to bow diaphragm 20 as will be described in more detail below. The frusto-conical shape of valve face 50 is oriented so that angled conical surface 56 extends into valve seat 17 such that the depth of surface 56 is greatest at its outermost perimeter. Thus, valve face 50 is indented into valve seat 17 a maximum extent adjacent raised rim 22. While a frusto-conical shape is preferred, it will be understood that valve face 50 may have a variety of different shapes other than frusto-conical. For example, valve face 50 may not include a circular flat surface 54, but instead might solely include an angled, conical surface. As other alternatives, valve face 50 may be substantially planar, valve face 50 may be a curved concave shape, or valve face 50 may have a plurality of angled flat surfaces instead of angled, conical surface 56. It is contemplated that the most preferred configuration is any angled shape of valve face 50 wherein the depth of valve face 50 is greatest at its outermost perimeter. Such shapes support the diaphragm during the reverse cycle of fluid flow along a center area of valve face 50 which expands outwardly as the reverse fluid pressure is increased. Such shapes also substantially prevent diaphragm 20 from contacting valve face 50 at its deepest perimeter adjacent raised rim 22.

A plurality of cylindrical channels 18 are defined in valve face 50 of valve seat 17. In the illustrated embodiment, six channels 18 are defined in valve seat 17 and are oriented to intersect angled, conical surface 56 of valve face 50 in a circular fashion. A center support 24 is axially oriented in the center of each channel 18. Center supports 24 include an angled downstream end 64 that is angled approximately the same as angled, conical surface 56 so as to lie generally in the same plane as that region of valve face so immediately adjacent channel 18. Center supports 24 are secured to valve seat 17 by a bridge ring 62 substantially concentric to circular valve face 50 and disposed adjacent an upstream side 46 of valve seat 17 (FIG. 2). Bridge ring 62 is thus removed from valve face 50. Center supports 24 are connected to bridge ring 62 upstream of angled downstream ends 64. Center supports 24 each provide a point of contact that support diaphragm 20 during the reverse cycle of fluid flow so that diaphragm 20 is not excessively deformed across channels 18. The support provided by supports 24 enables diaphragm 20 to be made thinner than that which could otherwise span channels 18 without being drawn down into channels 18 on the reverse stroke, and thus provide sufficient durability to repeated high speed cycling of the valve 10. The thinness of diaphragm 20 also decreases power consumption and speeds response time. In the preferred embodiment, center supports 24 have a circular cross-sectional shape that is substantially concentric to the circular cross-sectional shape of channels 18. In an alternative embodiment, the span of bridge ring 62 across each channel 18 is recessed into the inlet plenum or chamber in order to reduce constriction at the entry into channels 18.

A plug recess 66 is defined in valve seat 17 in the center of valve face 50 (FIGS. 2–4). Plug recess 66 is surrounded concentrically by flat surface 54 of valve face 50. Plug recess 66 is shaped to securely receive a plug 68 on diaphragm 20. When diaphragm 20 is secured to valve seat 17 via the securing of plug 68 in plug recess 66, an upstream surface 70 of diaphragm 20 extends over all of valve face 50, including channels 18 therein, and onto and beyond raised rim 22. Because diaphragm 20 is secured to valve seat 17 in a position indented from raised rim 22, diaphragm 20 is bowed by its contact with raised rim 22. The bowing of diaphragm 20 biases diaphragm 20 toward a closed position, i.e. a position where upstream surface 70 of diaphragm 20 contacts and is fluidly sealed near its perimeter against raised rim 22. The bowing of diaphragm 22 gives valve 16 a better response characteristic by snapping closed more quickly upon a drop in forward fluid pressure (i.e. during the return stroke). This characteristic is especially important in a high-speed reciprocating environment.

Figure 6:
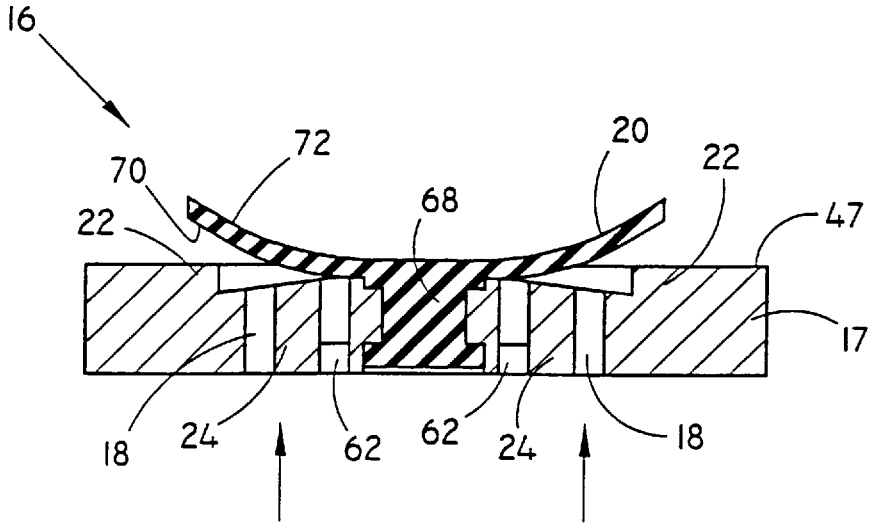

When pump 10 is shut off and valve 16 is in a rest position, upstream surface 70 of diaphragm 20 is spaced a small distance away from angled downstream ends 64 of center supports 24. Only during the return stroke of pump 10, when the fluid pressure is greater on a downstream surface 72 of diaphragm 20 than upstream surface 70, will diaphragm 20 contact center supports 24, and then typically only along a portion. The space between diaphragm 20 and center supports 24 allows the fluid upstream of diaphragm 20 to exert pressure against upstream surface 70 of diaphragm 20 over a greater area than would otherwise be possible without this space. With the fluid exerting pressure over a greater area, diaphragm 20 will experience a greater forward opening force during the forward cycle, and less pressure will therefore be required to open valve 16 (FIG. 6). Consequently less energy will be consumed by valve 16 and a faster response time will be produced. Diaphragm 20 is made of a pliable yet durable material in order to require minimal energy to open and yet withstand the pressures of a high-speed environment. Resilient, elastomeric materials are suitable, and in the preferred embodiment diaphragm 20 is made of neoprene. Alternatively diaphragm 20 may be made of Latex, Silicone, Buna-N, EDDM, Viton, or other suitable resilient elastomeric material.

During the return fluid cycle, valve 16 will be closed and pushed against a portion of downstream ends 64 of center supports 24. Because of the frusto-conical shape of surface 52 in combination with raised rim 22, diaphragm 20 will not contact all of the frusto-conical surface of valve face 50 nor necessarily all of downstream ends 64 of center supports 24. The area of upstream surface 70 of diaphragm 20 against which the fluid can exert pressure will therefore be greater than the sum of the cross-sectional areas of channels 18 (minus the center support cross-sectional areas). Consequently, less energy will be consumed to crack open valve 16 from a reverse cycle position. It can therefore be seen that valve 16 is both energy efficient and durable as a result of its unique configuration.

While the present invention finds applicability in valves having a range of dimensions, the relative dimensions of valve 16 in a preferred embodiment of a 15 LPM valve are as follows. The diameter of diaphragm 20 is 0.687 inches. Diaphragm 20 has a thickness of 0.017 inches. The diameter of valve face 50 is 0.625 inches. The depth of raised rim 22 is 0.021 inches. The diameter of channels 18 is 0.156 inches and the diameter of center supports 24 is 0.063 inches. The diameter of bridge ring 62 is 0.405 inches. While valves with the same or similar ratios of dimensions are within the scope of this invention, as noted above, valves with similar configurations but different ratios are also within the scope of this invention.

With the preferred embodiment high pump speeds in the range of six thousand to nine thousand revolutions per minute may be attained. The preferred valve operates with high differential pressures reaching approximately fifty pounds per square inch, and draws vacuums as high as ninety-five percent. The preferred valve 10 thus effectively provides fluid flow in applications which would cause other valve diaphragms to "float" and lose pump effectiveness.

While the present invention has been described in terms of the preferred embodiments depicted in the drawings and discussed in the above specification, it will be understood by one skilled in the art that the present invention is not limited to these particular embodiments, but includes any and all such modifications that are within the spirit and scope of the present invention as defined in the appended claims.

The embodiments of the invention in which an exclusive property or privilege is claimed are as follows:

1. A diaphragm valve for a high speed reciprocating pump, said valve adapted to allow a fluid to flow through said valve in only a downstream direction, said valve comprising:

a valve seat having an upstream and a downstream side, said valve seat having a valve face indented into said valve seat and surrounded by a rim, at least a portion of said valve face extending into said valve seat at an angle such that said valve face is indented into said valve seat to maximum extent adjacent said rim;

at least one channel defined by said valve seat, said at least one channel intersecting said valve face; and a diaphragm disposed in said valve seat having an upstream surface facing said valve face, said diaphragm being formed in a generally planar shape, said diaphragm movable between an open and a closed position, said diaphragm fluidly sealed against said rim when said diaphragm is in the closed position, said rim disposed in said valve seat such that said diaphragm is bowed from said generally planar shape and biased towards the closed position.

2. The diaphragm valve of claim 1, wherein said diaphragm is disposed in the downstream side of said valve seat in the center of said valve face.

3. The diaphragm valve of claim 2, wherein said diaphragm is made of neoprene.

4. The diaphragm valve of claim 3, wherein said fluid is a gas.

5. The diaphragm valve of claim 1, wherein said valve face is adapted to allow fluid to act against an area of said upstream surface of said diaphragm which is greater than the cross-sectional area of the at least one channel.

6. The diaphragm valve of claim 1, further comprising a high speed reciprocating pump coupled to said valve.

7. A diaphragm valve for a high speed reciprocating pump, said valve adapted to allow a fluid to flow through said valve in only a downstream direction, said valve comprising:

a valve seat having an upstream and a downstream side, said valve seat having a valve face indented into said valve seat and surrounded by a rim, at least a portion of said valve face extending into said valve seat at an angle such that said valve face is indented into said valve seat to a maximum extent adjacent said rim;

at least one channel defined by said valve seat, said at least one channel intersecting said valve face;

at least one support disposed in said at least one channel; and a diaphragm disposed in said valve seat having an upstream surface facing said valve face, said diaphragm movable between an open and a closed position, said diaphragm fluidly sealed against said rim when said diaphragm is in the closed position such that said diaphragm is bowed and biased towards the closed position.

8. The diaphragm valve of claim 7, wherein said at least one support includes a downstream end spaced from said diaphragm such that said diaphragm contacts a portion of said support downstream end only when the fluid pressure is greater on the downstream side of said valve seat than the upstream side.

9. The diaphragm valve of claim 3, wherein said support downstream end is angled at the same angle as said valve face.

10. The diaphragm valve of claims 2, wherein said support is an elongated member having a longitudinal axis, said support longitudinal axis oriented generally parallel to the direction of fluid flow through said channel.

11. The diaphragm valve of claim 10, wherein said support has a downstream end and an upstream end said support downstream end disposed proximate said valve face and said support upstream end coupled to said valve seat and spaced from said valve face.

12. The diaphragm valve of claim 7, wherein said valve face has a flat center surface surrounded by an angled conical surface, and said at least one channel intersects said angled conical surface.

13. The diaphragm valve of claim 12, wherein a plurality of channels are disposed in said valve seat and intersect said angled conical surface in a circular fashion.

14. A diaphragm valve for a high speed reciprocating pump, said valve adapted to allow a fluid to flow only in a downstream direction, comprising:

a valve seat having an upstream and a downstream side;

a raised rim on the downstream side of said valve seat defining a valve face surrounded by said raised rim, said valve seat defining a plurality of channels disposed in said valve seat and through said valve face, said channels adapted to allow the fluid to flow therethrough, each said channel having a cross-sectional area;

a plurality of supports disposed axially in said plurality of channels, each said support having a downstream end; and, a diaphragm movable between an open and a closed position and disposed on the downstream side of said valve seat over said valve face and said raised rim such that said diaphragm is bowed and biased toward the closed position, said diaphragm having an upstream surface facing said plurality of channels, and said diaphragm disposed in said valve seat such that the area of said upstream surface of said diaphragm in contact with the fluid is greater than the sum of the cross-sectional areas of said plurality of channels.

15. The diaphragm valve of claim 14, wherein said downstream ends of said supports are angled with respect to the downstream side of said valve seat.

16. The diaphragm valve of claim 15, wherein said downstream ends of said supports are spaced from said diaphragm when said valve is in a rest position.

17. The diaphragm valve of claim 16, wherein said supports are disposed in the center of said channels.

18. The diaphragm valve of claim 17, wherein said supports are secured in said channels by a bridge ring secured to said supports upstream from said downstream ends of said supports.

19. The diaphragm valve of claim 14, wherein said valve face has a frusto-conical shape and said downstream ends of said supports are angled to correspond to said frusto-conical shape of said valve face.

20. The diaphragm valve of claim 14, wherein said valve face has a flat center surface surrounded by an angled, conical surface and said channels are arranged in a circle in said angled, conical surface and around said flat center surface.

21. The diaphragm valve of claim 14, wherein said diaphragm is secured to the downstream side of said valve seat in the center of said valve face.

22. The diaphragm valve of claim 14, wherein said fluid is a gas.

23. The diaphragm valve of claim 22, wherein said diaphragm is made of neoprene.

24. The diaphragm valve of claim 14, further comprising a high speed reciprocating pump coupled to said valve.

25. A diaphragm valve for a high speed reciprocating pump, said valve adapted to allow fluid to flow through said valve only in a downstream direction, said valve comprising:

a valve seat having an upstream and a downstream side;

a valve face disposed on said downstream side of said valve seat;

said valve seat defining a raised rim about said valve face;

said valve seat defining a plurality of flow channels therethrough, said flow channels opening through said valve face;

each said flow channel having an elongated diaphragm support disposed axially therein, each said diaphragm support having a downstream end disposed proximate said valve face and an upstream end coupled to said valve seat away from said valve face; and a diaphragm membrane mounted on said valve seat at said valve face, said diaphragm membrane overlaying said valve face and said raised rim to define a selectively closed position in which said diaphragm membrane bows from said valve face to said raised rim, and a selectively open position in which said diaphragm membrane is spaced from said raised rim, wherein said diaphragm support downstream end prevents said diaphragm membrane from being drawn substantially into said channels.

* * * * *

UNITED STATES PATENT AND TRADEMARK OFFICE

CERTIFICATE OF CORRECTION

PATENT NO. : 5,803,122
DATED : Sept. 8, 1998
INVENTOR(S) : Thomas Theilmeier

It is certified that error appears in the above-identified patent and that said Letters Patent is hereby corrected as shown below:

Column 7, line 7:
"3" should be --8--

Column 7, line 10:
"2" should be --7--

Signed and Sealed this

Thirty-first Day of August, 1999

*Attest:*

Q. TODD DICKINSON

*Attesting Officer*

*Acting Commissioner of Patents and Trademarks*